US005758764A

United States Patent [19]

Garoffolo et al.

[11] Patent Number: 5,758,764

[45] Date of Patent: Jun. 2, 1998

[54] ZERO BOUNCE SWITCH

[75] Inventors: Nick Garoffolo, Westport, Conn.; Paul Kadar, Seaford; Steve Campolo, Valley Stream, both of N.Y.

[73] Assignee: Leviton Manufacturing Co., Inc., Little Neck, N.Y.

[21] Appl. No.: 711,767

[22] Filed: Sep. 10, 1996

[51] Int. Cl.[6] ..... H01H 3/60

[52] U.S. Cl. ..... 200/559; 200/288

[58] Field of Search ..... 200/288, 559, 200/DIG. 42

[56] References Cited

U.S. PATENT DOCUMENTS 3,172,972 3/1965 Schleicher ..... 200/288 X
3,474,205 10/1969 Peek, Jr. ..... 200/288
4,053,729 10/1977 Reiter ..... 200/288
4,220,934 9/1980 Wafer et al. ..... 200/288 X
4,650,946 3/1987 Maier et al. ..... 200/288

*Primary Examiner*—Renee S. Luebke
*Attorney, Agent, or Firm*—Paul J. Sutton

[57] ABSTRACT

To prevent the contacts of an electrical switch bouncing when the switch is operated, with the attendant arcing and contact erosion, spring mass mechanisms are added adjacent the spring arms and contacts to engage such spring arms and contacts and transfer the vibrational energy to such spring mass mechanisms and permit the spring arms and contacts to operate without any contact bounce. An energy absorber can be used alternatively to absorb the vibrational energy. A combination of spring mass mechanism for one spring arm/contact assembly and an absorber for the second spring arm/contact assembly can be employed.

6 Claims, 4 Drawing Sheets

ZERO BOUNCE SWITCH

BACKGROUND OF THE INVENTION

1. Field of the Invention

The invention is directed to the field of electrical switches and more particularly to an electrical switch whose contacts open and close in a positive manner without contact bounce.

2. Description of the Prior Art

All electrical switches containing spring type terminals when operated exhibit a phenomenon called "bounce." A spring loaded movable terminal arm strikes a stationary terminal arm, when the switch is closed, and due to the resilience of one or both of the terminal arms, the terminal arms separate, contact one another again, then separate until a steady state condition is reached with the contacts fully closed. The movement of current carrying contacts towards and away from each other produces arcing between the contacts which deteriorates the contact surfaces. The removal of contact surface increases the current density at the contacts which can become high enough to weld the contacts together or cause them to burn.

SUMMARY OF THE INVENTION

The instant invention overcomes the shortcomings and problems of prior art electrical switches containing spring type terminal arms by providing an electrical switch which absorbs or transfers the energy produced by oscillations created in the spring terminal arms when the spring terminal arms are opened or closed during the operation of the switch.

In a first embodiment, a first tuned spring mass, tuned to the natural frequency of the stationary spring arm and contact, is placed in contact with the stationary spring arm and contact so that any energy produced in the stationary spring arm and contact due to oscillations created in the stationary spring arm and contact as a result of the opening or closing of the movable contact by the movable spring arm with the stationary spring arm and contact is transferred to the first tuned spring mass so that such energy has no effect on the stationary spring arm and contact. A second tuned spring mass, tuned to the natural frequency of the movable spring arm and contact, is placed in contact with the movable spring arm and contact to receive the energy transferred from such movable spring arm and contact to prevent movement of the movable spring arm and contact. The second tuned spring mass and the movable spring arm and contact may be unitary.

A second embodiment continues the use of a tuned spring mass in contact with and formed as a unitary member with the movable spring arm and contact. An energy absorber, made of a resilient material, is substituted for the tuned spring mass in contact with the stationary spring arm and contact. The energy absorber absorbs the energy present in the stationary spring arm and contact and prevents such energy from affecting the stationary spring arm and contact.

The third embodiment is similar to the second embodiment except that the spring mass and movable spring arm and contact are two separate members separately mounted and supported. It is an object of this invention to provide zero bounce electrical switches.

It is an object of this invention to provide electrical switches with spring mounted contacts that do not bounce upon the operation of such switches.

It is another object of this invention to provide electrical switches with spring mounted contacts having means to absorb or accept the transfer of the vibrational energy present in the springs due to the operation of such switch.

It is still another object of this invention to provide a tuned spring mass to accept the vibrational energy produced in a spring arm member of a switch to prevent such spring arm member bouncing upon operation of such switch.

It is yet another object of this invention to provide an absorber to accept the vibrational energy produced in a spring arm member of a switch to prevent such spring arm member bouncing upon operation of such switch.

It is still another object of this invention to provide a tuned spring mass adjacent one spring arm member of an electrical switch to accept the transfer of vibrational energy and an absorber adjacent a second spring arm member of such switch to accept vibrational energy, said spring mass and said absorber accepting the vibrational energy of its adjacent spring arm member produced upon the operation of said switch.

Other objects and features of the invention will be pointed out in the following description and claims and illustrated in the accompanying drawings, which disclose, by way of example, the principles of the invention, and the best modes which are presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
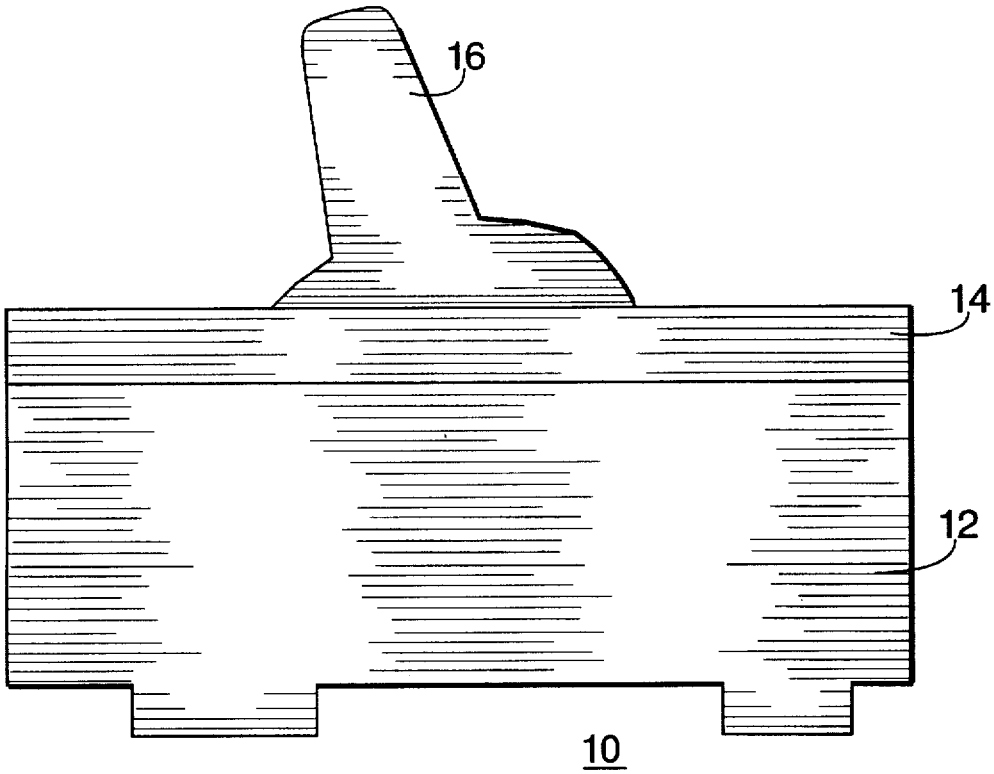
FIG. 1 is a front elevational view of a fully assembled toggle switch housing used to house electrical switches of the prior art and electrical switches according to the instant invention.
Figure 2:
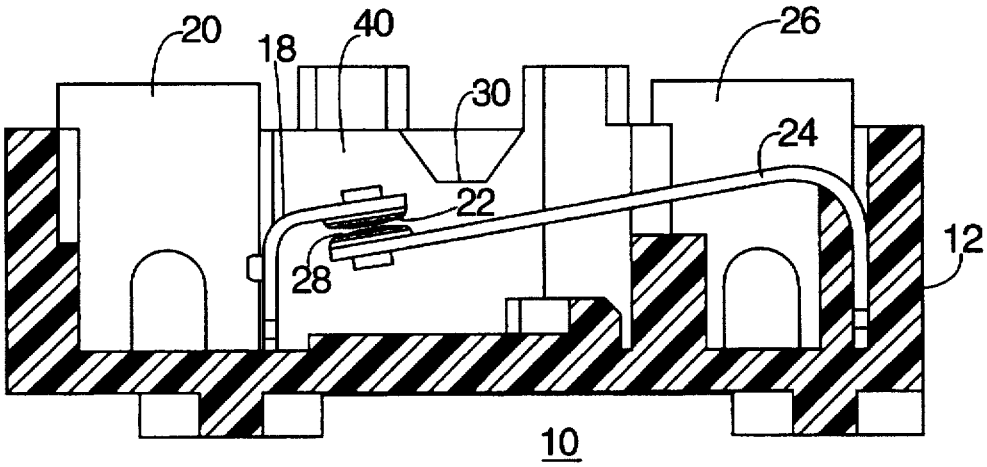
FIG. 2 PRIOR ART
FIG. 2 is a sectional view of the body of the housing of FIG. 1 with switch elements according to the prior art installed therein.
Figure 3:
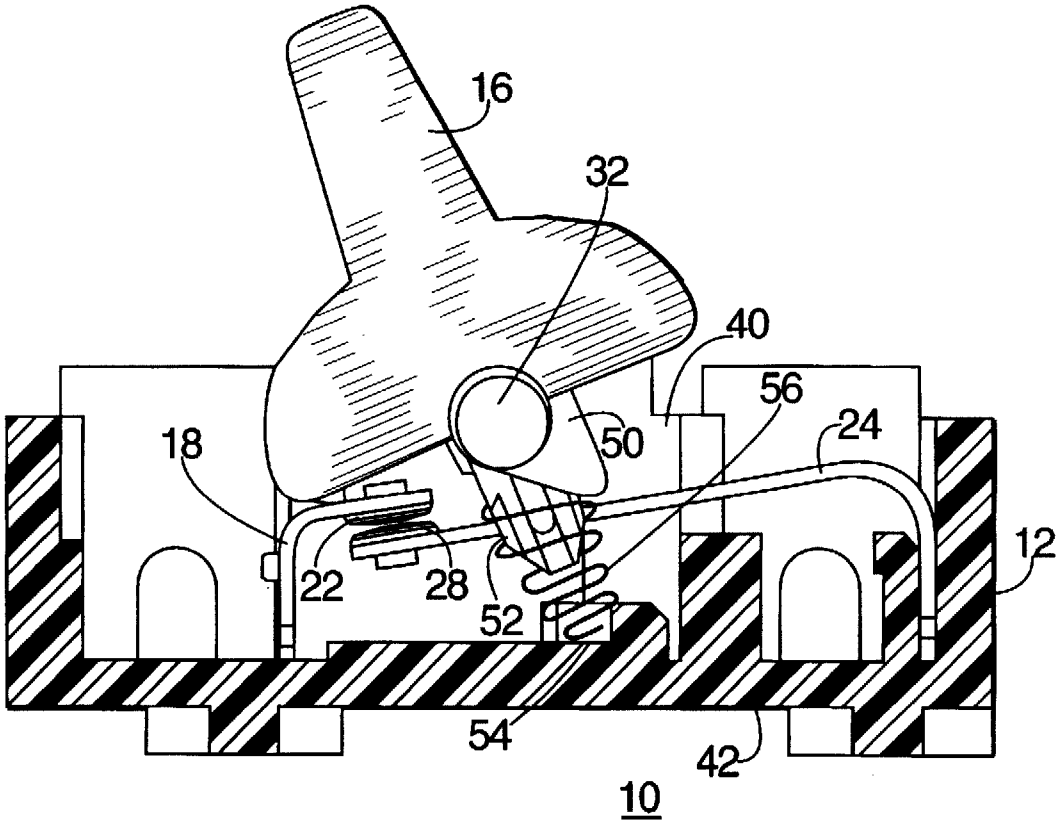
FIG. 3 PRIOR ART
FIG. 3 is a sectional view of the body of the housing of FIG. 1, the switch toggle and additional details of the prior art switch shown in FIG. 2.

FIG. 1 shows the exterior of a typical toggle lever operated electrical switch 10. A body portion 12 contains the switch components which are operated by toggle lever 16 which extends through a slot in a cover plate 14 which retains the toggle lever 16 in place and otherwise seals the open top surface of body portion 12. With toggle lever 16 in one position the switch contacts are separated and the switch 10 is considered to be in the "off" position. When the toggle lever 16 is moved to a second position the switch contacts are made to engage completing an electrical circuit and switch 10 is considered to be in the "on" position. FIGS. 2 and 3 show the interior of body portion 12 in which are placed a stationary spring arm 18 which terminates in a stationary electrical contact 22. Spring arm 18 is integral with plate 20 to which one electrical conductor may be fastened by a terminal screw or the like (not shown). A movable spring arm 24 is integral with plate 26 to which a second electrical conductor may be fastened by a terminal screw or the like (not shown). Movable spring arm 24 terminates in a movable contact 28. In the position shown in FIGS. 2 and 3 the contacts 22 and 28 are engaged and the electrical circuit is closed and current will flow between contacts 22 and 28.

As shown in FIG. 3 the toggle lever 16 has a short cylindrical shaft 32 on each side, only one of which is visible in FIG. 3, which engage notches 30 on the interior of the rear wall 40 shown in FIG. 2 and the interior of the front wall (not shown). The toggle lever 16 is held in place by cover plate 14 which retains each of the shafts 32 in its associated notch 30 and permits the shaft 32 to rotate within such associated notch 30. Extending from the bottom of toggle lever 16 is a cam 50 which engages movable spring arm 24 as the toggle lever 16 is moved from the "on" position to the "off" and causes the movable spring arm 24 to move downwardly towards the bottom wall 42 of body portion 12. This action separates the contacts 22 and 28 and opens the electrical circuit. When the toggle arm 16 is moved from the "off" position to the "on" position, as shown in FIG. 3, the movable spring arm 24 is free to move the movable contact 28 into engagement with stationary contact 22. It is during such closure that contact bounce most often occurs in devices of the prior art. Some bounce can also occur when the contacts 22 and 28 are separated.

An extension 52 extends from the bottom of toggle lever 16 and receives thereabout a positioning spring 56 the other end of which is positioned in a recess 54 in bottom wall 42. Extension 52, recess 54 and spring 56 provide an over-center retaining mechanism to retain toggle lever 16 in each of two distinct positions as is well known in the art.

As was stated above, when the movable spring arm 24 is released by the cam 50 of the toggle lever 16, it returns to its initial position and brings the movable contact 28 into contact with the stationary contact 22. If all of the energy stored in the movable spring arm 24 is not dissipated, the movable spring arm 24 will bounce a number of times until the stored energy is dissipated. Some energy may be transferred to the stationary spring arm 18 causing it to also oscillate.

Since the circuit closed by the switch contacts 22, 28 is otherwise electrically energized, arcing between the movable and stationary contacts 28, 22, respectively, will occur whenever the dielectric constant of the air between the contacts 22, 28 is exceeded. This arcing causes erosion of portions of the contact surfaces which can cause an increased current density at the remaining portions of the contacts causing them to be welded together or burn or otherwise prevent proper operation of the switch.

Figure 4:
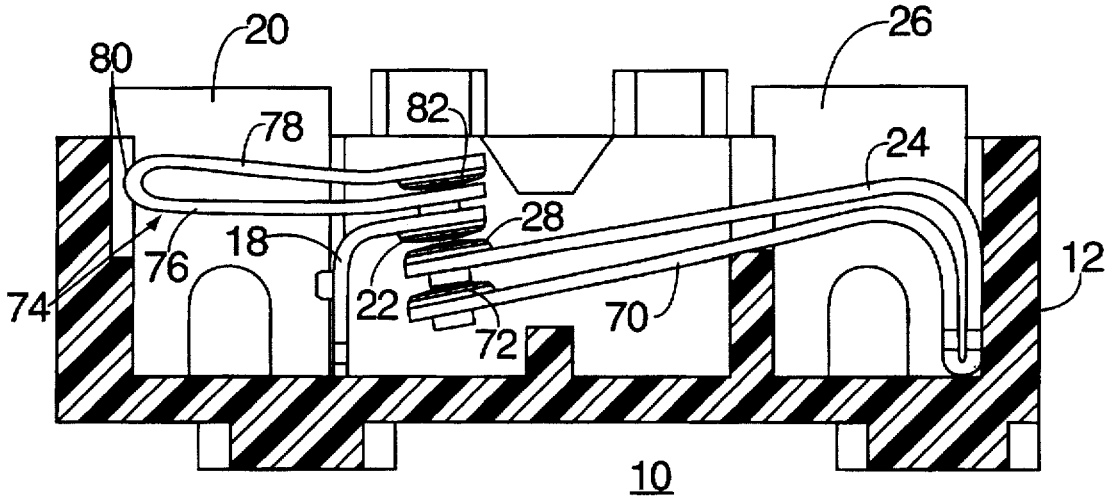
FIG. 4 is a sectional view of the body of the housing of FIG. 1 with an electrical switch according to a first embodiment of the instant invention installed therein.

One way of preventing contact bounce or providing a zero bounce switch is by including a tuned spring mass adjacent to and in contact with each of the stationary spring arm and movable spring arm. The tuned spring mass permits the energy of the vibrations or oscillations created in its associated spring arm, when the switch 10 is operated, to be transferred from the spring arm to the associated tuned spring mass and thus not influence the spring arm. This is shown in FIG. 4.

The movable spring arm 24 constitutes the spring and the contact 28 constitutes the mass of the spring mass system which has a natural frequency at which it will vibrate when struck. This is the same as striking a tuning fork. The natural frequency at which the spring mass system vibrates is defined by the formula:

$$W_{Natural}=(K/M)^{1/2}$$

where K is the stiffness of the spring

M is the mass.

It has been found experimentally that the vibrational energy of one spring mass system can be transferred to a second spring mass system if both have the same natural frequency. By transferring such energy, the transferring spring mass system will be prevented from vibrating and causing the contacts to bounce.

A second spring arm 70 terminating in a contact 72 is formed integrally with movable spring arm 24 and plate 26. Contact 72 is in contact with movable contact 28. The value of the stiffness of the spring 70 and the mass of the contact 72 are so chosen that the natural frequency at which they will vibrate is the same as the natural frequency of the movable spring arm 24 and contact 28. Thus the spring mass system including spring arm 70 and contact 72 is tuned to the natural frequency of the spring mass system of spring arm 24 and contact 28.

A second spring mass system is used to transfer the vibrational energy of the stationary spring mass system of spring arm 18 and stationary contact 22. The spring 74 is made up of two segments 76 and 78 which overlie one another and which are connected at the byte 80 to the plate 20. A contact 82 is connected to the free end of segment 78 remote from the byte 80. The free end of segment 76 is positioned in contact with contact 82 but not joined to it. Because the spring arm 18 is intended to remain stationary, the spring arm 18 is fabricated from material stiffer than movable spring arm 24 and as a result bounces at a higher frequency than the movable spring arm 24. Again, the spring arm 74 and the contact 82 mass are so chosen as to vibrate at the same natural frequency as the stationary spring arm 18 and contact 22.

Thus when movable contact 28 is closed upon stationary contact 22, the spring mass system, of spring arm 70 and contact 72 will receive the vibrational energy of movable spring arm 24 and contact 28 and movable spring arm 24 and contact 28 will not bounce. Similarly, the spring mass system of spring arm 74 and contact 82 will receive the vibrational energy of the stationary spring arm 18 and contact 22 and stationary spring arm 18 and contact 22 will not bounce.

Figure 5:
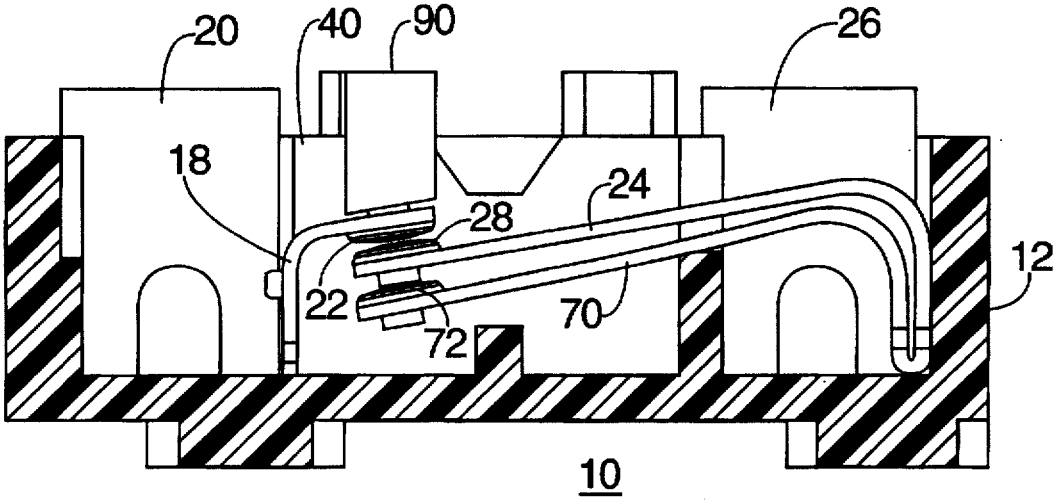
FIG. 5 is a sectional view of the body of the housing of FIG. 1 with an electrical switch according to a second embodiment of the instant invention installed therein.

Another manner in which the vibrational energy of a spring arm and contact can be removed is by means of direct contact with an energy absorber made of a resilient material such as natural or synthetic rubber, elastomeric, plastic or the like. In FIG. 5 an absorber 90 is placed in contact with stationary spring arm 18 and contact 22 to absorb the vibrational energy imparted by the operation of the switch 10. Absorber 90 is attached to the rear wall 40 of body portion 12 by a resilient epoxy or other adhesive or by a metal band or the like (not shown). The spring mass system, spring arm 70 and contact 72, will operate in the same manner as described with respect to FIG. 4.

Figure 6:
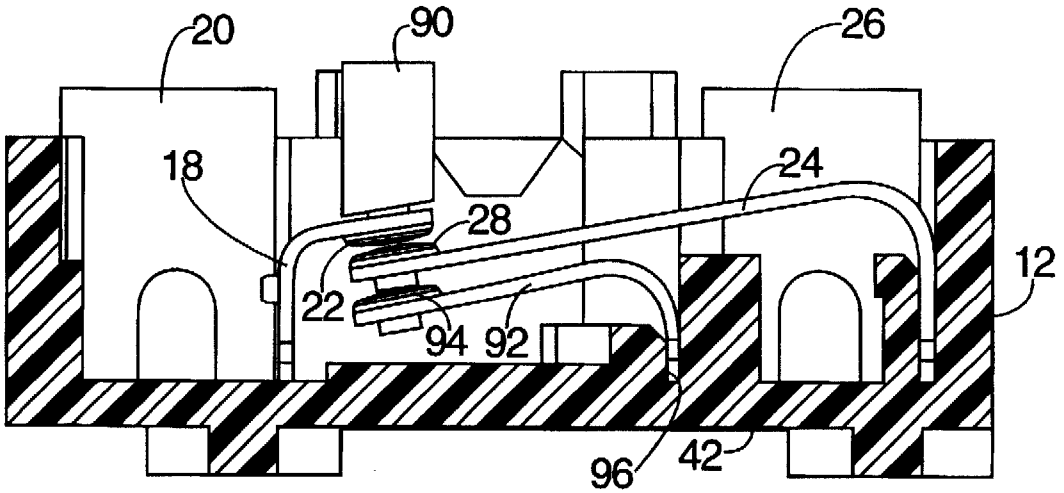
FIG. 6 is a sectional view of the body of the housing of FIG. 1 with an electrical switch according to a third embodiment of the instant invention installed therein.

The damping spring mass system does not have to be formed as an integral portion of the spring arm and contact which it operates with as is shown in FIG. 4. Instead, the spring arm 92 and mass 94 can be separately fabricated and the free end of the spring arm 92 anchored in an appropriate slot 96 in the bottom wall 42 of the body portion 12, as is shown in FIG. 6. The spring mass system of spring arm 92 and mass, contact 94, will operate in the same manner as the spring mass system of spring arm 70 and mass, contact 72, to receive the vibrational energy transferred from movable spring arm 24 and contact 28.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A zero bounce switch comprising:

a) a body member having a front wall and a back wall spaced apart and substantially parallel to said front wall, a first end wall and a second end wall spaced apart and substantially parallel to said first end wall and a bottom wall, said front wall, said back wall, said first end wall and said second end wall joined to said bottom wall to form a rectangular body member open at the top and with a central cavity therein;

b) toggle means rotatably mounted upon said front wall and said back wall, within said central cavity;

c) cam means mounted upon said toggle means and within said central cavity, said cam means being adjacent said first end wall when said toggle means is in a first position and adjacent said second end wall when said toggle means is in a second position;

d) stationary contact means mounted to said body member adjacent said first end wall;

e) movable contact means mounted to said body member adjacent said second end wall and engageable by said cam means, said movable contact means being moved away from contact with said stationary contact means when said toggle means is moved to said first position and said movable contact means is permitted to contact said stationary contact means when said toggle means is moved to said second position;

f) first damping means adjacent said stationary contact means to dampen any oscillations created in said stationary contact means due to the movement of said movable contact means, said first damping means has a natural frequency equal to a natural frequency of said stationary contact means; and g) second damping means adjacent said movable contact means to dampen any oscillations created in said movable contact means due to the movement of said movable contact means, said second damping means has a natural frequency equal to a natural frequency of said movable contact means;

h) said natural frequency of said first damping means is higher than said natural frequency of said second damping means.

2. A zero bounce switch, as defined in claim 1, wherein said first damping means is in direct contact with said stationary contact means and dampens any oscillations created in said stationary contact means by the transfer of the vibrational energy of the oscillations of said stationary contact means to said first damping means.

3. A zero bounce switch, as defined in claim 1, wherein said second damping means is in direct contact with said movable contact means and dampens any oscillations created in said movable contact means by the transfer of the vibrational energy of the oscillations of said movable contact means to said second damping means.

4. A zero bounce switch, as defined in claim 1, wherein:

a) said first damping means is in direct contact with said stationary contact means and dampens any oscillations created in said stationary contact means by the transfer of the vibrational energy of the oscillations of said stationary contact means to said first damping means; and b) said second damping means is in direct contact with said movable contact means and dampens any oscillations created in said movable contact means by the transfer of the vibrational energy of the oscillations of said movable contact means to said second damping means.

5. A zero bounce switch comprising:

a) a body member having a front wall and a back wall spaced apart and substantially parallel to said front wall, a first end wall and a second end wall spaced apart and substantially parallel to said first end wall and a bottom wall said front wall, said back wall, said first end wall and said second end wall joined to said bottom wall to form a rectangular body member open at the top and with a central cavity therein;

b) toggle means rotatably mounted upon said front wall and said back wall, within said central cavity;

c) cam means mounted upon said toggle means and within said central cavity, said cam means being adjacent said first end wall when said toggle means is in a first position and adjacent said second end wall when said toggle means is in a second position;

d) stationary contact means mounted to said body member adjacent said first end wall;

e) movable contact means mounted to said body member adjacent said second end wall and engageable by said cam means, said movable contact means being moved away from contact with said stationary contact means when said toggle means is moved to said first position and said movable contact means is permitted to contact said stationary contact means when said toggle means is moved to said second position;

f) first damping means adjacent said stationary contact means to dampen any oscillations created in said stationary contact means due to the movement of said movable contact means, said first damping means is a first spring mass system having a first natural frequency defined by $W_{Natural1}=(K_1/M_1)^{1/2}$ where $K_1$ is the stiffness of a first spring and $M_1$ is a first mass; and g) second damping means adjacent said movable contact means to dampen any oscillations created in said movable contact means due to the movement of said movable contact means, said second damping means is a second spring mass system having a second natural frequency defined by $W_{Natural2}=(K_2/M_2)^{1/2}$ where $K_2$ is the stiffness of a second spring and $M_2$ is a second mass;

h) said frequency $W_{Natural1}$ is higher than the frequency $W_{Natural2}$.

6. A zero bounce switch, as defined in claim 5, wherein said second spring mass and said movable contact means are connected at a point adjacent said second end wall.

* * * * *